US006097163A

United States Patent [19]

Chauvin et al.

[11] Patent Number: 6,097,163

[45] Date of Patent: Aug. 1, 2000

[54] ELECTRON BEAM DEFLECTION APPARATUS USING AN AUXILIARY DEFLECTION COIL AND A COMPENSATION COIL

[75] Inventors: Jacques Chauvin; Bernhard Malota, both of Mönchweiler; Albert Runtze, Villingen-Schwenningen, all of Germany

[73] Assignee: Deutsche Thomson-Brandt GmbH, Villingen-Schwennigen, Germany

[21] Appl. No.: 09/024,507

[22] Filed: Feb. 17, 1998

[30] Foreign Application Priority Data

Feb. 22, 1997 [DE] Germany ..... 197 07 069

[51] Int. Cl.[7] ..... H01J 29/56; H01J 29/70

[52] U.S. Cl. ..... 315/368.26; 315/368.25; 315/368.28; 315/370; 315/8; 313/428

[58] Field of Search ..... 315/368.25, 368.26, 315/368.27, 368.28, 370, 8; 348/807; 313/428, 431, 440; 335/213, 214

[56] References Cited

U.S. PATENT DOCUMENTS

| | | | |
|---|---|---|---|
| 3,663,907 | 5/1972 | Barkow | 335/211 |
| 3,912,970 | 10/1975 | Chandler et al. | 315/370 |
| 3,930,185 | 12/1975 | Barkow et al. | 315/370 |
| 4,339,736 | 7/1982 | Burr et al. | 335/213 |
| 4,410,840 | 10/1983 | Beeteson et al. | 315/368.18 |
| 4,725,763 | 2/1988 | Okuyama et al. | 315/368 |
| 4,833,370 | 5/1989 | Sakurai et al. | 315/368 |
| 5,157,305 | 10/1992 | Satoh et al. | 315/370 |
| 5,177,412 | 1/1993 | Morohashi et al. | 315/370 |
| 5,258,693 | 11/1993 | Roussel et al. | 315/370 |
| 5,317,239 | 5/1994 | Ohguro et al. | 315/370 |
| 5,469,122 | 11/1995 | Yoon | 335/214 |

FOREIGN PATENT DOCUMENTS

| | | | |
|---|---|---|---|
| 0050692 | 5/1982 | European Pat. Off. . | |
| 0484260 | 5/1992 | European Pat. Off. | H01J 29/76 |
| 9517763 | 6/1995 | WIPO . | |

OTHER PUBLICATIONS

K. Kobayashi et al., "A high–resolution 20–inch, in–line display CRT for 64 kHz horizontal scanning", Toshiba Review, No. 155, 1986, pp. 24–28.

Japanese Patent Abstracts, JP 6–197359.

Search Report for German Patent Appln. No. 197 07 069.8.

*Primary Examiner*—Edward P. Westin

*Assistant Examiner*—Nikita Wells

*Attorney, Agent, or Firm*—Joseph S. Tripoli; Joseph J. Laks; Daniel E. Sragow

[57] ABSTRACT

An apparatus for electron beam deflection in a cathode ray tube, in particular in a picture tube of a television set, comprises a deflection coil arrangement for horizontal and vertical deflection of the electron beam, an auxiliary deflection coil arrangement, by means of which the electron beam can be influenced for the purpose of convergence correction, and a compensation coil arrangement for producing a magnetic compensation field. The compensation coil arrangement is arranged and designed such that the compensation field essentially compensates for the stray magnetic field of the deflection coil arrangement in the physical region of the auxiliary deflection coil arrangement.

7 Claims, 3 Drawing Sheets

ELECTRON BEAM DEFLECTION APPARATUS USING AN AUXILIARY DEFLECTION COIL AND A COMPENSATION COIL

BACKGROUND OF THE INVENTION

1. Field of the Invention

The invention relates to an apparatus for electron beam deflection in a cathode ray tube, in particular in a picture tube, which has a deflection coil arrangement for horizontal and vertical deflection of the electron beam and which comprises an auxiliary deflection coil arrangement, by means of which the electron beam can be influenced for the purpose of convergence correction.

2. Description of Related Art

In contrast to conventional television sets, the television picture in projection television sets is produced by means of three monochrome colour picture tubes for the colours red, green and blue, in such a manner that the pictures of the individual colour picture tubes are projected onto a common projection screen. The individual picture tubes are arranged alongside one another, so that their projection axes are not parallel to one another. Furthermore, two of the three projection axes of the picture tubes do not run at right angles to the screen, which leads to projection errors. In addition to these projection errors and independently of them, cushion distortion occurs in the picture tubes, which contributes to poor picture reproduction in the same way as the projection errors.

In order to achieve good picture reproduction, it is thus necessary to correct the images from the individual colour picture tubes. In practice, this is done using auxiliary deflection coils for convergence correction, which are assigned to the individual colour picture tubes. Such auxiliary deflection coils are known in the prior art.

U.S. Pat. No. 4,833,370 discloses an electron beam deflection system for cathode ray tubes which, on the one hand, is equipped with deflection coils for horizontal and vertical beam deflection and, on the other hand, is equipped with auxiliary deflection coils which ensure convergence correction for the beam deflection.

In the case of the known deflection system, the deflection coils and the auxiliary deflection coils are wound on the same core. On the one hand, this results in a particularly compact construction, with the picture tubes having a shortened physical length. On the other hand, the immediate proximity to the main deflection coils causes a large voltage to be induced in the auxiliary deflection coils, and this impedes the required convergence correction. It is therefore necessary to compensate for this induced voltage. This is done by a transformer using which a voltage corresponding to the said induced voltage but of opposite polarity is produced. In the case of this known apparatus, an induced voltage is thus compensated for by a second induced voltage of opposite polarity.

In conventional picture tubes for projection television sets, the main deflection coils and the auxiliary deflection coils are not wound on a common core, but are arranged alongside one another on the neck of the picture tube. As a result of the physical separation, the stray magnetic fields of the main deflection coils, which fields pass through the auxiliary deflection coils, are smaller and, in consequence, the induced voltage caused by them is also smaller. This induced voltage has until now been compensated for by an amplifier circuit which, based on preset correction values, emits to the auxiliary deflection coils the current required for convergence correction. The compensation for the induced voltage caused by the main deflection coils places a considerable load on the amplifier circuit. Furthermore, the associated amplifier is no longer operating in its linear region, which leads to impaired convergence correction.

In the worst case, the induced voltage is so large that the amplifier becomes saturated.

SUMMARY OF THE INVENTION

Based on this, the object of the invention is to relieve the load on the amplifier circuit assigned to the auxiliary deflection coils.

This object is achieved according to the invention in that the apparatus has a compensation coil arrangement for producing a magnetic compensation field, by means of which the magnetic field of the deflection coil arrangement can essentially be compensated for, at least in the physical region of the auxiliary deflection coil arrangement.

This results in the stray magnetic fields of the deflection coil arrangement no longer inducing a voltage in the auxiliary deflection coil arrangement which has to be compensated for by an amplifier circuit assigned to the auxiliary deflection coil arrangement. This leads to a considerable reduction in the load on the amplifier circuit. A further advantage of this arrangement is that the compensation is not achieved by means of an additional induced voltage, but, instead of this, by a further magnetic field. There is therefore no need for a transformer to produce the further induced voltage. The compensation coil arrangement for producing the compensation magnetic field can be manufactured very economically, in comparison with a transformer.

In order to achieve a relationship that is as good as possible between the effort and the costs for the apparatus, it is possible for the compensation coil arrangement to be restricted to such an extent that only the stray magnetic fields caused by the horizontal beam deflection can be compensated for. The effects of vertical beam deflection on the auxiliary deflection coils are considerably less than those of horizontal beam deflection, so that a considerable reduction in the load on the amplifier circuit, and improvement in the convergence correction, can be achieved with comparatively little effort.

The concept of compensating for the voltage induced in the auxiliary deflection coil arrangement by means of an opposing magnetic field instead of an opposing voltage is independent of the physical form of the auxiliary deflection coil arrangement. The apparatus according to the invention can thus be used both for auxiliary deflection coil arrangements of a multipole design and for those which are designed as a toroidal coil. In order to amplify the magnetic field of the auxiliary deflection coil arrangement, a magnet core can be provided on which at least one coil of the auxiliary deflection coil arrangement is wound. This magnet core may expediently be designed as a soft-magnetic ferrite core.

A particularly low level of complexity for the compensation coil arrangement can be achieved if the compensation coil arrangement is physically assigned to the auxiliary deflection coil arrangement. It is thus particularly advantageous for the compensation coil arrangement to be wound on the same core as the auxiliary deflection coil arrangement.

In order to achieve complete compensation for the stray magnetic fields of the deflection coil arrangement, it is necessary for the magnetic field of the compensation coil arrangement to be matched to the stray magnetic fields of the main deflection coil arrangement not only in terms of dimensions but also in time. This can be done in a particularly simple manner by connecting the compensation coil arrangement in series with the main deflection coil arrangement.

DESCRIPTION OF THE DRAWING

The drawing illustrates two exemplary embodiments of the apparatus according to the invention and, in the figures.

DETAILED DESCRIPTION

Figure 1:
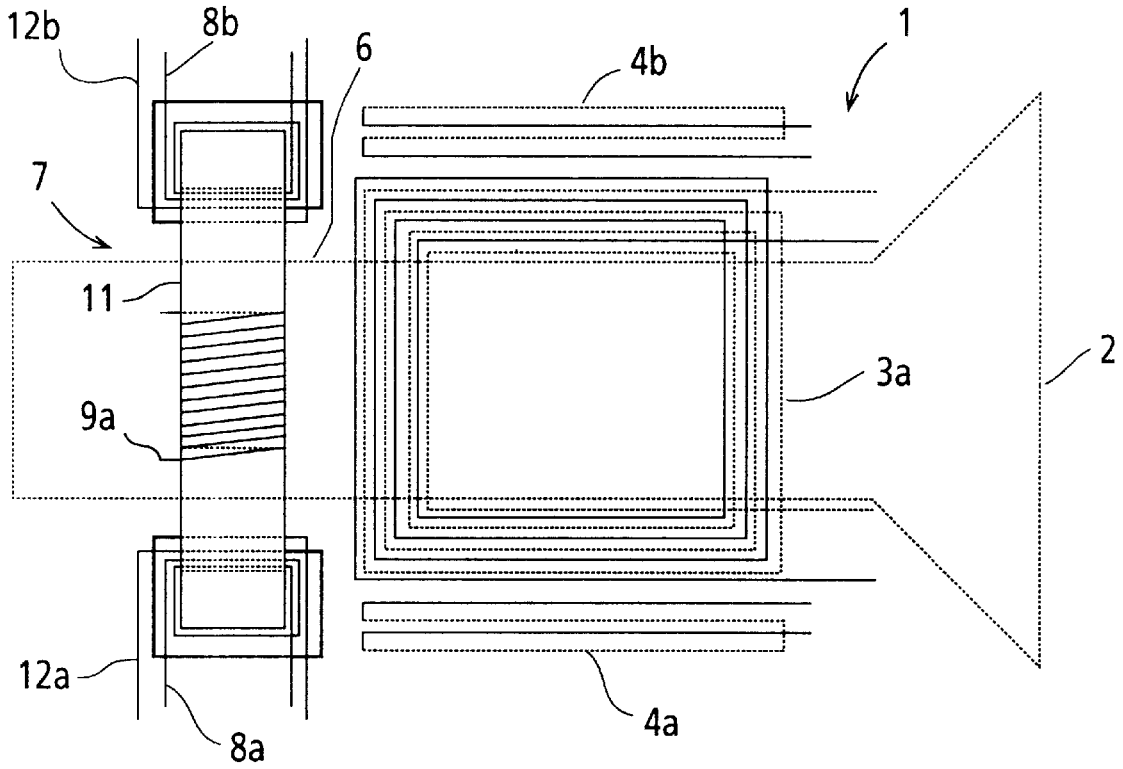
FIG. 1 shows a schematic illustration indicating how the apparatus according to the invention is arranged on a picture tube, the convergence coil arrangement being designed as a toroidal coil.

FIG. 1 shows schematically a picture tube which is designated as an entity by 1 and which has at one of its ends a screen 2 with a fluorescent layer. On the side opposite the screen 2, the picture tube 1 is provided with a system for producing, accelerating and focusing an electron beam, although this system is not illustrated, for the sake of clarity. At the point where the electron beam strikes the fluorescent layer, it produces an image point. In order to allow the individual lines of a television picture to be written by this electron beam, it is necessary to deflect the electron beam both horizontally and vertically. To this end, a pair of deflection coils 3*a* are provided for horizontal deflection of the electron beam in the picture tube 1, and a pair of deflection coils 4*a*, 4*b* are provided for vertical deflection. Only one of the two horizontal deflection coils can be seen in FIG. 1. The second horizontal deflection coil is arranged directly opposite the first deflection coil 3*a*, on the other side of the picture tube 1. The deflection coils 3*a*; 4*a*, 4*b* are designed as saddle coils and are arranged fixed on the neck of the picture tube 1. Furthermore, the picture tube neck 6 is fitted with an auxiliary deflection coil arrangement 7 which, seen in the direction of the electron beam, is located in front of the main deflection coils 3*a*; 4*a*, 4*b*.

In the present exemplary embodiment, the auxiliary deflection coil arrangement 7 is designed as a toroidal coil. The toroidal coil has two pairs of coils 8*a*, 8*b*; 9*a* although only the coil 9*a* of the second pair can be seen in FIG. 1. The coils 8*a*, 8*b*; 9*a* are wound on an annular, soft-magnetic ferrite core 11 and produce, respectively, a horizontal and vertical magnetic field for convergence correction. A compensation coil 12*a*, 12*b* is in each case wound on the same ferrite core 11, together with the two coils 8*a*, 8*b*, for horizontal convergence correction.

Figure 2:
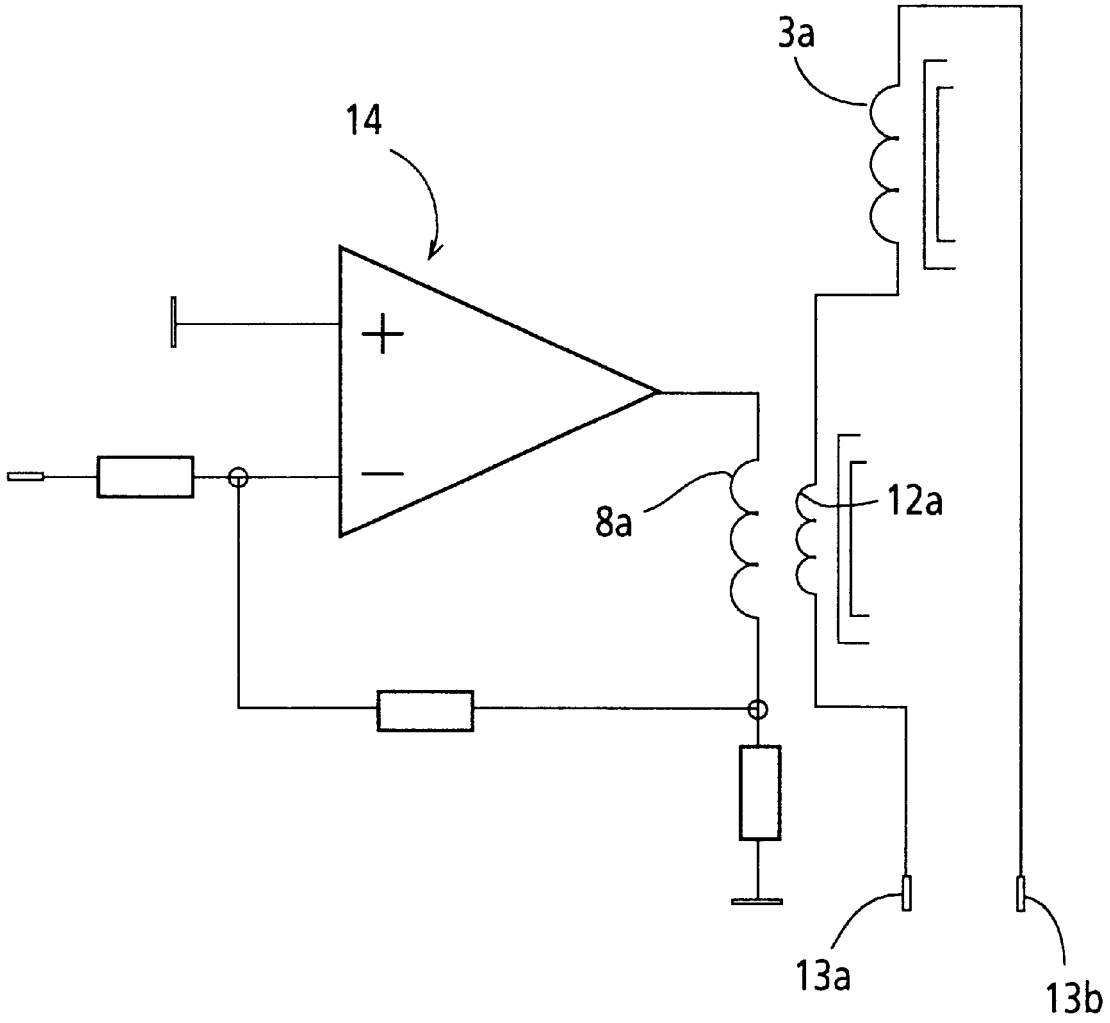
FIG. 2 shows a schematic illustration of the circuitry of the apparatus according to the invention.

FIG. 2 illustrates schematically the circuitry of the coil arrangement, only in each case one coil 3*a*, 8*a* and 12*a* of the deflection coil arrangement, the auxiliary deflection coil arrangement and the compensation coil arrangement being illustrated, for the sake of simplicity.

The deflection current is fed into the horizontal deflection coil 3*a* at the connections 13*a*, 13*b*. The compensation coil 12*a* is connected in series with the deflection coil 3*a* such that the current flowing through the compensation coil 12*a* is the same as that which flows through the deflection coil 3*a*. The inductance of the compensation coil 12*a* is relatively small, so that there is no significant phase shift in the current between the compensation coil 12*a* and the deflection coil 3*a*.

The auxiliary deflection coil 8*a* is connected by both of its inputs to an amplifier circuit which is designated as an entity by 14.

The apparatus described so far operates as follows:

A current is fed into the deflection coil 3*a* at the connections 13*a*, 13*b*. The magnetic field produced by this current causes horizontal deflection of the electron beam of the picture tube. The same current at the same time flows through the compensation coil 12*a* and produces a magnetic field in the region of the auxiliary deflection coil 8*a*, this magnetic field being called the compensation field in the following text. The compensation coil 12*a* is designed such that the compensation field opposes the stray field of the deflection coil 3*a* at the location of the auxiliary deflection coil 8*a* and essentially corresponds to it in terms of magnitude. This results in the stray field of the horizontal deflection coil 3*a* not inducing any voltage in the auxiliary deflection coil 8*a*. In consequence, it is no longer necessary for the amplifier circuit 14, to compensate for currents produced by the induction voltage, which results in a reduced power consumption being achieved. However, above all, this ensures that the amplifier circuit 14 is working in its optimum operating region and never saturates which, as mentioned initially, has a damaging effect on picture reproduction quality.

Figure 3:
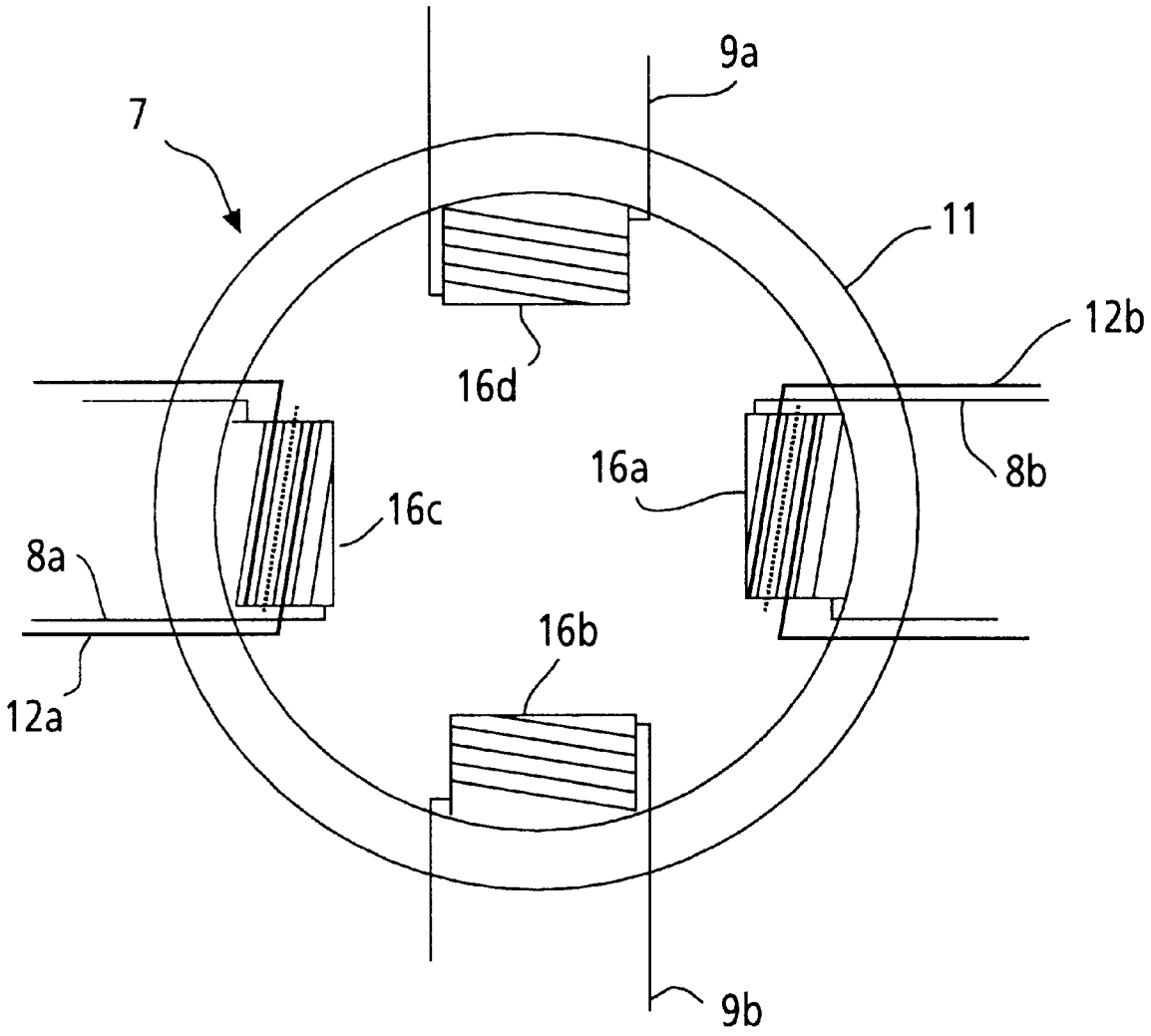
FIG. 3 shows a schematic illustration of a four-pole auxiliary deflection coil arrangement having two compensation coils.

FIG. 3 illustrates the auxiliary deflection coil arrangement 7 of another exemplary embodiment. This exemplary embodiment differs from the first exemplary embodiment in that the auxiliary deflection coil arrangement is designed as a four-pole coil arrangement. The vertical and horizontal auxiliary deflection coils 8*a*, 8*b*; 9*a*, 9*b* are wound on an essentially round ferrite core 11 which has 4 projections 16*a* . . . 16*d* designed like pole shoes. Compensation coils 12*a*, 12*b* are wound on the horizontal auxiliary deflection coils 8*a*, 8*b* in a similar way to that in the first exemplary embodiment. The rest of the construction and method of operation of this exemplary embodiment are otherwise identical, so that there is no need for any further description.

It is also possible to apply the invention to apparatuses for electron beam deflection in a picture tube in which auxiliary deflection coil arrangements other than those described are used. For example, it is possible in addition to apply the invention to auxiliary deflection coil arrangements which are designed as six-pole or eight-pole coil arrangements.

In principle, it is also possible to apply the invention to vertical deflection coils, that is to say to compensate for their stray magnetic fields in the region of the auxiliary deflection coils. However, in practice this is generally unnecessary since the stray magnetic fields produced by the vertical deflection coils have a much less disturbing effect.

We claim:

1. Apparatus for electron beam deflection in a cathode ray tube, in particular in a picture tube, which has a deflection coil arrangement for horizontal and vertical deflection of the electron beam and which comprises an auxiliary deflection coil arrangement wound on a core, by means of which the electron beam can be influenced for the purpose of convergence correction, the apparatus having a compensation coil arrangement also wound on said core, at least one coil of the compensation coil arrangement being electrically connected in series with at least one coil of the deflection coil arrangement.

2. Apparatus according to claim 1, in which the compensation coil arrangement is designed such that the only magnetic fields which can essentially be compensated for are those which originate from the deflection coils of the deflection coil arrangement which are assigned to horizontal deflection of the electron beam.

3. Apparatus according to claim 1, in which the auxiliary deflection coil arrangement is designed as a multipole coil arrangement having at least one coil.

4. Apparatus according to claim 1, in which the auxiliary deflection coil arrangement is a toroidal coil arrangement having at least one coil.

5. Apparatus according to claim 1, in which the at least one core is a ferrite core.

6. Apparatus for electron beam deflection in a cathode ray tube, in particular in a picture tube, which has a deflection coil arrangement for horizontal and vertical deflection of the electron beam and which comprises an auxiliary deflection coil arrangement, by means of which the electron beam can be influenced for the purpose of convergence correction, the apparatus having a compensation coil arrangement for producing a magnetic compensation field, by means of which the magnetic field of the deflection coil arrangement can essentially be compensated for, at least in the physical region of the auxiliary deflection coil arrangement, at least one coil of the compensation coil arrangement being electrically connected in series with at least one coil of the deflection coil arrangement, said auxiliary deflection coil arrangement being designed as a multipole coil arrangement having at least one coil, said auxiliary deflection coil arrangement having at least one coil which is wound on at least one core, said compensation coil arrangement being physically assigned to the auxiliary deflection coil arrangement.

7. Apparatus for electron beam deflection in a cathode ray tube, in particular in a picture tube, which has a deflection coil arrangement for horizontal and vertical deflection of the electron beam, and which comprises an auxiliary deflection coil arrangement, by means of which the electron beam can be influenced for the purpose of convergence correction, the apparatus having a compensation coil arrangement for producing a magnetic compensation field, by means of which the magnetic field of the deflection coil arrangement can essentially be compensated for, at least in the physical region of the auxiliary deflection coil arrangement, at least one coil of the compensation coil arrangement being electrically connected in series with at least one coil of the deflection coil arrangement, the auxiliary deflection coil arrangement being designed as a multipole coil arrangement having at least one coil, said auxiliary deflection coil arrangement having at least one coil which is wound on at least one core, at least one core of the auxiliary deflection coil arrangement being also fitted with at least one coil of the compensation coil arrangement.

* * * * *